United States Patent [19]

Harris

[11] Patent Number: 4,730,570

[45] Date of Patent: Mar. 15, 1988

[54] VARIABLE BEAM TRIMARAN

[76] Inventor: Donald R. Harris, 32021 Pacific Coast Hwy., South Laguna, Calif. 92677

[21] Appl. No.: 901,142

[22] Filed: Aug. 28, 1986

[51] Int. Cl.[4] ..... B63B 7/00

[52] U.S. Cl. ..... 114/61; 114/123; 114/354

[58] Field of Search ..... 114/61, 123, 352, 354, 114/283

[56] References Cited

U.S. PATENT DOCUMENTS

| | | | |
|---|---|---|---|
| 1,710,625 | 4/1929 | Kapigian | 114/123 |
| 3,045,263 | 7/1962 | Blachly | 114/352 |

FOREIGN PATENT DOCUMENTS

| | | | |
|---|---|---|---|
| 785040 | 7/1935 | France | 114/123 |
| 1467880 | 2/1967 | France | 114/123 |
| 1568965 | 5/1969 | France | 114/123 |

OTHER PUBLICATIONS

Popular Science, vol. 167, No. 2, Aug. 1955 pp. 194–195.

*Primary Examiner*—Joseph F. Peters, Jr.
*Assistant Examiner*—Edwin L. Swinehart
*Attorney, Agent, or Firm*—William L. Chapin

[57] ABSTRACT

The main hull of a trimaran supports starboard and port side auxiliary hulls or floats by front and rear pairs of horizontally disposed crossarms which are removably fastened at their outer ends to an auxiliary hull, and slidably fastened at their inner ends to the main hull. Port holes coaxially aligned with each starboard/port side pair of crossarms are provided through the starboard and port side sides of the main hull. U-bolt clamps joining the inner ends of the crossarms to the main hull may be loosened, permitting starboard and port side auxiliary hulls to be retracted inwardly by sliding the crossarms through the port holes into the interior of the main hull until the inner facing surfaces of starboard crossarms abut inner facing surfaces of port side crossarms. By removing entirely every other odd crossarm on one side of the main hull and every other even crossarm on the opposite side of the main hull, clearance is provided permitting both auxiliary hulls to be fully retracted into positions contacting the main hull by sliding alternate crossarms through an adjacent port hole, through the interior of the main hull, and out through the opposite port hole. With both auxiliary hulls thus fully retracted, the beam of the trimaran is substantially reduced, facilitating docking and trailering the vessel.

5 Claims, 17 Drawing Figures

VARIABLE BEAM TRIMARAN

BACKGROUND OF THE INVENTION

1. Field of the Invention

This invention relates to multihull sailboats; specifically those having a central main hull and an auxiliary side hull on either side of the main hull and referred to as a trimaran. More specifically, the present invention relates to a trimaran in which the width or beam of the vessel may be varied.

2. Description of Background Art

Single hull sail boats are conventionally equipped with a large, heavy keel extending downward from the bottom of the hull. A keel is required to counteract the tendency of a boat to roll (heel over) excessively about the longitudinal axis of the boat when it encounters heavy seas and/or stiff winds.

The large weight of the heel, concentrated at a posiion well below the hull of the vessel, lowers the center of gravity of the vessel. This provides a static righting force counteracting the tendency of the vessel to roll.

Typically, the keel of a sailboat has a broad flat shape, as viewed from the side of the vessel. The large surface area of the keel provides a substantial resisting force to rapid movement through water in a direction perpendicular to the surface. Thus, the keel provides a dynamic resisting force counteracting the tendency of the sailboat to rapidly heel over.

Trimarans avoid the requirement for a large and heavy keel by using auxiliary hulls or floats, one on either side of the main hull of the sailboat. The auxiliary hulls or floats are usually attached to the main hull by means of connecting crossarms transversely disposed between the main hull and each float. Typically, the floats are of an elongated shape, and in parallel alignment with the main hull of the sailboat, at equal distance on either side of the main hull. The transverse cross-sectional shape of both the main hull and the floats are so configured as to provide a hydrodynamically streamlined body, which may move longitudinally on the surface of water with a minimum amount of drag.

Auxiliary hulls or floats eliminate the requirement for a large and heavy keel as follows. The upwardly directed buoyancy force on a float, multiplied times the relatively long moment arm comprised by the distance between the float and roll axis of the main hull, provides a large torque ending to counteract excessive roll of the main hull in either a clockwise or counterclockwise direction.

The distance between the outer lateral edges of the floats of a trimaran is referred to as the beam of the vessel. A large beam typical for a trimaran is advantageous for sailing purposes, as has been described. However, the large beam can be disadvantageous when the boat is docking in crowded areas, or being transported by trailer. Accordingly, it would be advantageous to provide means for varying the beam of a trimaran.

A number of prior patents disclose a variety of structures for varying the beam width of a trimaran or other vessel. The following U.S. patents are typical of prior art disclosing variable beam width vessels:

Sanner, U.S. Pat. No. 4,286,534, Sept. 1, 1981, Trimaran Sailboat.

Woods, U.S. Pat. No. 1,683,276, Sept. 4, 1928, Boat.

Dornier, U.S. Pat. No. 2,271,065, Jan. 27, 1942, Fuselage for Hydroaircraft.

Robinson, U.S. Pat. No. 3,139,058, June 30, 1964, Multiple Hull Water Vehicles.

Miller, U.S. Pat. No. 3,925,837, Dec. 16, 1975, Boat Hull Construction.

Davy, U.S. Pat. No. 3,960,102, June 1, 1976, Trimarans.

Lindsay, U.S. Pat. No. 3,937,166, Feb. 10, 1976, Float Connection Assemblies for Multi-Hulled Boats.

Winch, U.S. Pat. No. 3,996,874, Dec. 14, 1976, Surface Craft.

Andersson, U.S. Pat. No. 4,392,444, July 12, 1983, High Stability Trimaran.

Thurston, U.S. Pat. No. 4,457,248, July 3, 1984, Multihull Vessels.

Typical prior art trimarans having a variable beam disclose the use of pivotable or hinged joints between the main hull, crossarms and floats of the vessel. The variable beam trimaran according to the present invention eliminates the requirement for such joints.

OBJECTS OF THE INVENTION

An object of the present invention is to provide a trimaran sailboat construction by which the width or beam of the sailboat may be readily varied.

Another object of the invention is to provide a trimarin construction having side floats which may be retracted to positions flush with the sides of the superstructure of the trimaran.

Another object of the invention is to provide a trimaran construction in which either side float may readily be removed and reattached to the main hull of the trimaran.

Another object of the invention is to provide a trimarin construction in which the draft of the side floats may be readily adjusted.

Various other objects and advantages of the present invention, and its most novel features, will become apparent to those skilled in the art by reading the accompanying specification and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiments described. I do intend that reasonable equivalents, adaptations and modifications of the invention described herein be included within the scope of the invention as defined by the appended claims.

SUMMARY OF THE INVENTION

Briefly stated, the present invention comprehends an improved trimaran sailboat construction providing novel and advantageous means in which the beam width of the vessel may be varied.

The trimaran construction according to the present invention uses at least one pair of laterally disposed front crossarms to support the front portion of a side hull from the main hull. The longitudinal spacing between the two crossarms comprising the pair is relatively small compared to both the length of the main hull and the side hull. At least one pair of similarly disposed crossarms support the rear portion of a side hull.

Each crossarm is fastened near its inner end to the superstructure of the main hull by means of a U-bolt. A hole adapted to slidably receive a crossarm is provided through the side of the main hull in coaxial alignment with the inner transverse face of each crossarm. Normally, each hole is sealed by means of a hatch cover.

To reduce the beam of the trimaran a specified amount, covers are opened permitting crossarms to be slid into the uncovered holes.

To further reduce the beam of the trimaran, an alternate crossarm in each pair is removed, permitting the crossarm from the opposite float to slide through the hole in the near side of the hull, through the hull, past the center line of the hull, and out through the hole in the opposite side of the hull, if desired. Thus, by removing all of the even numbered crossarms on one side of the main hull and all of the odd numbered crossarms on the opposite side of the hull, the remaining crossarms may be slid all of the way through the main hull. This permits fully retracting both side floats until their inner sides abut the side of the main hull. Preferably, the superstructure of the main hull extends laterally beyond each side of the main hull a distance equal to the width of a float, thereby making the sides of the superstructure flush with the outer sides of the floats when the floats are fully retracted.

Shims are placed between the lower surface of the overhanging portions of the superstructure and the upper surface of each crossarm where the crossarm and superstructure are fastened together by means of a U-bolt. Varying the shim thickness permits varying the depth of the bottom of the float relative to the main hull. Thus, the draft of each float may be adjusted for the optimum value corresponding to varying drafts of the main hull resulting from different weight loading of passengers and cargo in the main hull.

DESCRIPTION OF THE PREFERRED EMBODIMENTS

Figure 1:
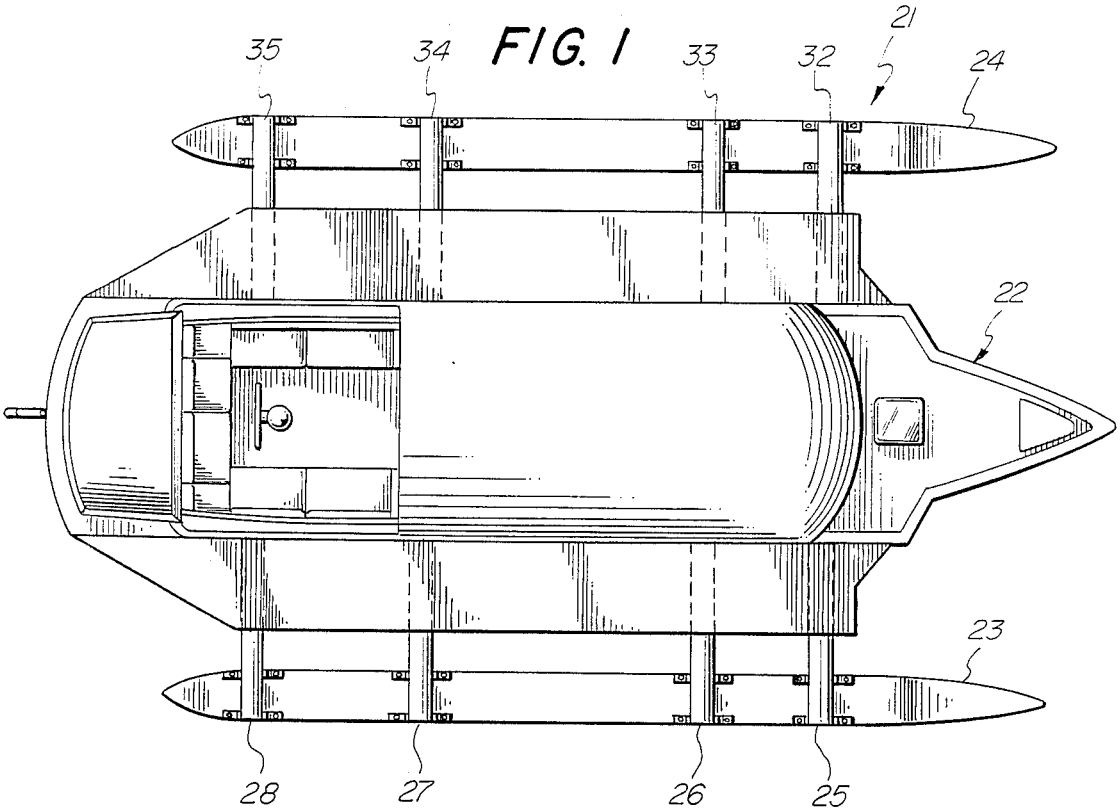
FIG. 1 is an upper plan view of a trimaran sailboat construction according to the present invention.
Figure 2:
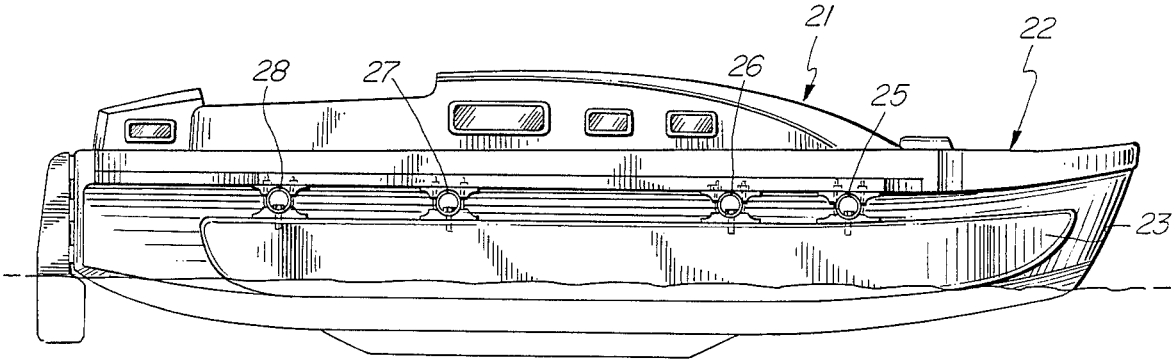
FIG. 2 is a starboard side elevation view of the trimaran of FIG. 1.

Referring now to FIGS. 1 through 4, a variable beam trimaran 21 according to the present invention is shown to include a main hull 22, a starboard auxiliary hull or float 23, and a port side auxiliary hull or float 24.

For clarity of illustration, masts, rigging, and sails of the trimaran are not shown.

Floats 23 and 24 are similarly shaped, each comprising an elongated, buoyant pontoon-like structure having in plan view ogival fore and aft ends providing minimum hydrodynamic resistance to longitudinal movement of the floats on the surface of water. As shown in FIG. 1, floats 23 and 24 are both oriented with their longitudinal axes parallel with the longitudinal axis of the main hull 22 of the trimaran 21.

Both starboard float 23 and port side float 24 are fastened to the main hull 22 of trimaran 21 by means of transversely disposed crossarms. As may be seen best by referring to FIGS. 1 and 4, starboard float 23 is attached to the outer ends of front crossarms 25 and 26 and rear crossarms 27 and 28. For purposes of convenience, the crossarms will be referred to as first, second, third and fourth. Thus, first and second front crossarms 25 and 26 comprise a relatively closely spaced pair of front crossarms. The third and fourth, rear crossarms 27 and 28 also comprise a relatively closely spaced pair of rear crossarms, positioned at a substantial distance back from the front crossarms.

Crossarms 25, 26, 27 and 28 are of substantially identical construction, each consisting of an elongated, generally uniform cross section beam. The crossarms are fabricated from wood or metal having sufficient rigidity to resist excessive flexure or breakage in response to the large bending moments which can be applied to the crossarms when wind or waves tend to roll the trimaran over. Preferably, crossarms 25, 26, 27 and 28 are fabricated from hollow steel or aluminum beams.

Figure 4:
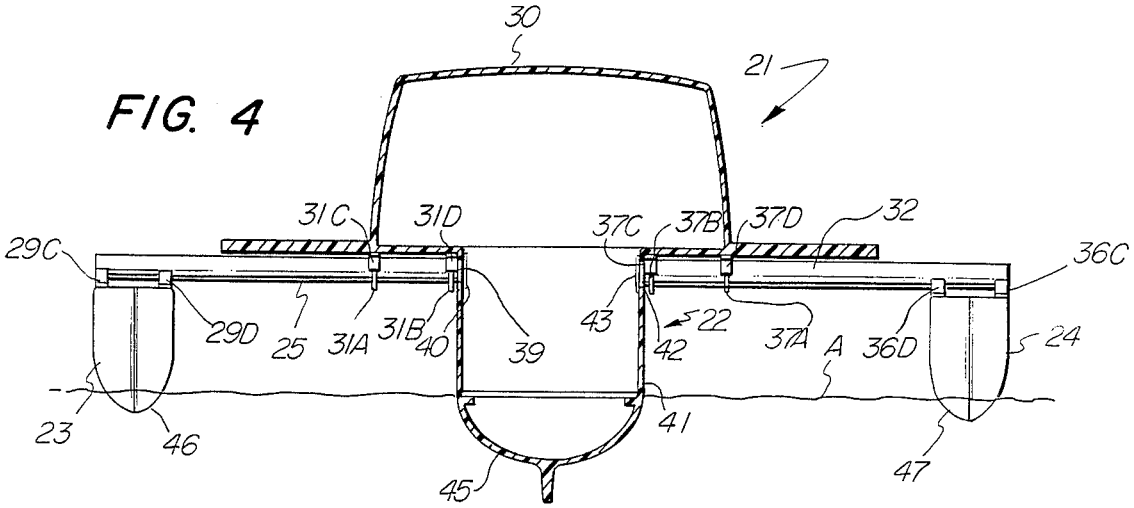
FIG. 4 is a sectional front elevation view of the trimaran of FIG. 1, taken along line 4—4 of FIG. 2.

As shown in FIGS. 1 and 4, starboard float 23 is fastened to the outer ends of crossarms 25–28 by means of bolts 29. Bolts 29A and 29B extend downward through saddle-shaped anchor blocks 29C and 29D secured to the upper surface of the float 23.

As may be seen best by referring to FIG. 4, the inner portion of each starboard crossarm 25–28 is bolted to the floor of the cabin superstructure 30 of trimaran 21 by means of U-bolts 31A and 31B which partially encircle the outer cross section of the crossarm. With crossarms 25–28 positioned to place starboard float 23 in its normally extended position for sailing, the inner transverse face of each crossarm is positioned close to the outer lateral surface of main hull 22. U-bolts 31A and 31B extend upward through saddle-shaped anchor blocks 31C and 31D, as shown in FIG. 4B.

Port side float 24 is joined to main hull 22 of trimaran 21 in an exactly analogous fashion to that described for starboard float 23. Thus, as shown in FIGS. 1 and 4, port side hull 24 is joined to main hull 22 by first and second, front crossarms 32 and 33, third and fourth, rear crossarms 34 and 35, bolts 36A and 36B, anchor blocks 36C and 36D, U-bolts 37A and 37B, and anchor blocks 37C and 37D.

Figure 3:
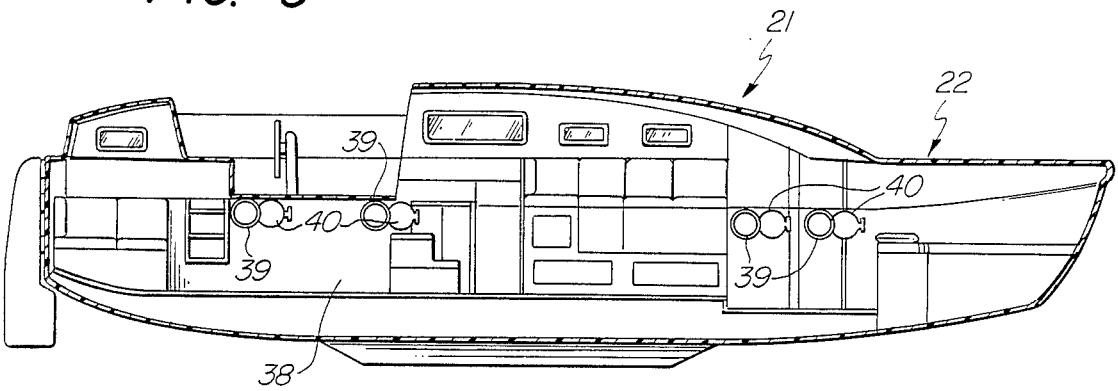
FIG. 3 is a starboard side elevation view similar to that of FIG. 2, but showing the starboard float and its supporting crossarms removed.

Referring now to FIG. 3, a starboard side elevation view of trimaran 21 is shown with starboard float 23 removed. Removal of starboard float 23 is readily accomplished by loosening U-bolts 31 fastening the inner ends of starboard float support crossarms 25–28, and sliding the crossarms and attached float laterally outwards away from main hull 22.

As shown in FIG. 3, the starboard side 38 of main hull 22 contains a plurality of port holes 39 disposed longitudinally along a line slightly below the junction of the main hull with cabin superstructure 30. Port holes 39, which communicate with the interior of main hull 22, are normally covered by covers 40. Each port hole 39 is positioned to be in coaxial alignment with a separate one of crossarms 25–28 when the latter are bolted in place to cabin superstructure 30.

Covers 40 are pivotably mounted to starboard side 38 of main hull 22. The diameter of port holes 39 is sufficiently large to permit crossarms 25–28 to be slid laterally inward through the port holes into the interior of main hull 22 when each cover 40 is pivoted away from a port hole to a position generally adjacent to the port hole and flush with starboard side 38 of main hull 22.

The port side 41 of main hull 22 contains a plurality of port holes 42 and covers 43 coaxially aligned with starboard side port holes 39 and covers 40. Thus, port side crossarms 32–35 may be slid laterally inward through port side port holes 42 with covers 43 pivoted away from the port holes, to positions rearward of the port holes.

The novel construction features of the trimaran according to the present invention provide an extremely versatile means for easily varying the maximum width, or beam, of the vessel, while not compromising its strength, as will now be described.

Figure 7:
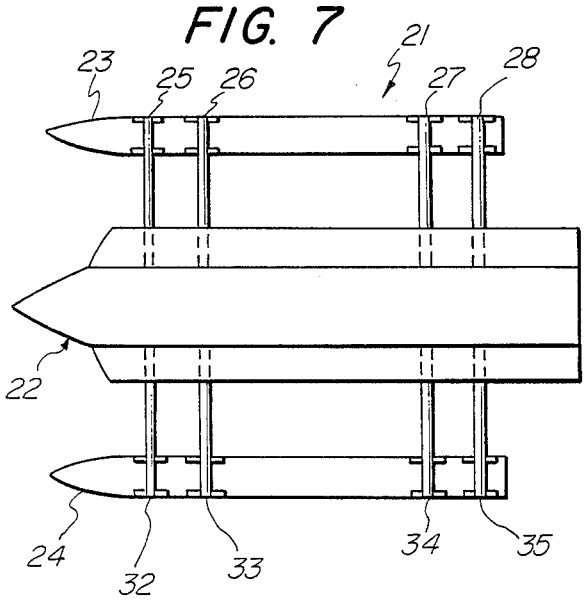
FIG. 7 is a schematic upper plan view of the trimaran of FIG. 1 with both starboard and port side floats fully extended to provide maximum beam for normal sailing.
Figure 8:
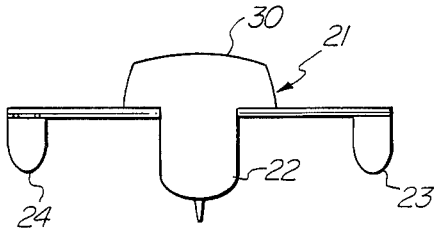
FIG. 8 is a schematic rear elevation view of the trimaran of FIG. 1 with its floats positioned as shown in FIG. 7.

Referring now to FIG. 7, a schematic upper plan view of the trimaran 21 is shown in which both starboard float 23 and port side float 24 are positioned at their maximum lateral distances from the main hull 22. It has been found that the optimum width to length ratio for catamarans cruising under normal sailing conditions is about 2 to 3. Thus, the lengths of starboard crossarms 25–28 and port side crossarms 32–35 are selected to make the distance between the outer lateral sides of starboard float 23 and port side float 24 equal to about two-thirds of the length of main hull 22. FIG. 8 is a rear elevation view of the trimaran 21 showing its starboard float 23 and port side float 24 at their maximum lateral distances from the main hull 22.

When it is desired to reduce the beam of trimaran 21, either starboard float 23 or port side float 24 may be retracted inwards from its maximum lateral displacement from the main hull 22 to a point closer to the main hull. Moreover, both floats may be retracted inwards towards the main hull.

Movement of floats 23 and 24 relative to main hull 22 to vary the beam of trimaran 21 is accomplished as follows. First, the covers 43 covering the port holes 42 on that side of the main hull adjacent to the float which it is desired to retract are unlocked and swung away from the port holes. If it is desired to retract both floats, all of the covers 43 covering port holes 42 are unlocked and swung away from the port holes.

With the port holes 42 opened by unlocking the covers 43 and swinging them away from the port holes, the U-bolts 31 holding the starboard crossarms 25–28 to the overhanging floor 44 of the cabin superstructure 30 are loosened. This permits the starboard crossarms 25–28 to be slid inwards through the open port holes 42 in the starboard side 38 of main hull 22 a desired distance from their maximum extended positions. The starboard float 23 is moved inwards towards the main hull the same distance, and retained in that position by re-tightening U-bolts 31.

Figure 9:
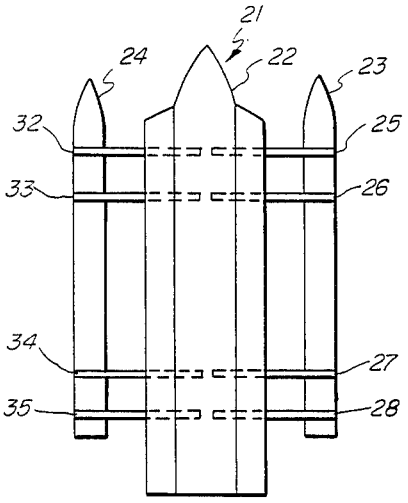
FIG. 9 is a schematic upper plan view of the trimaran of FIG. 1 with both starboard and port side floats slightly retracted to provide slightly reduced beam to the trimaran.
Figure 10:
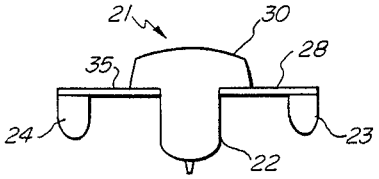
FIG. 10 is a schematic rear elevation view of the trimaran of FIG. 1 with its floats positioned as shown in FIG. 9.

In an exactly analogous fashion, the U-bolts 37 holding port side crossarms 32–35 may be loosened, permitting port side float 24 and crossarms to be slid inwards a desired distance, whereupon U-bolts 37 are re-tightened. In this manner, starboard float 23 and port side float 24 may be retracted inwards a distance sufficient to bring the transverse inner faces of starboard crossarms 25–28 in contact with the inner transverse faces of corresponding port side crossarms 32–35. FIG. 9 is a schematic upper plan view of trimaran 21 showing both starboard float 23 and port side float 24 retracted inwards sufficiently for the transverse inner faces of starboard crossarms 25–28 to abut the inner faces of corresponding port side crossarms 32–25. FIG. 10 is a schematic rear elevation view of the trimaran 21 with its floats 23 and 24 positioned as shown in FIG. 9. The beam reduction illustrated in FIGS. 9 and 10, which is equal to the width of the main hull 22 at the height of port holes 42, is adequate for some purposes. However, the beam of trimaran 21 may be reduced to a substantially greater degree in a manner now to be described.

Referring again to FIGS. 1–4, it may be seen that any desired starboard crossarms 25–28 or port side crossarms 32–35 may be removed entirely by loosening U-bolts 31 or 37 securing the inner end of a crossarm, removing bolts 29 or 36 securing the outer end of a crossarm to a starboard float 23 or port side float 24, and sliding the freed crossarm outwards from the loosened U-bolt. The crossarm thus removed may then be stowed on board the trimaran, in any convenient location.

Figure 11:
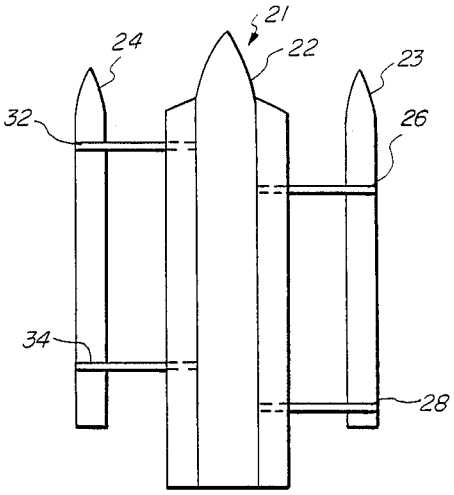
FIG. 11 is a schematic upper plan view of the trimaran of FIG. 1 with first and third (odd numbered) starboard float support crossarms removed and second and fourth (even numbered) port side float support crossarms removed.
Figure 12:
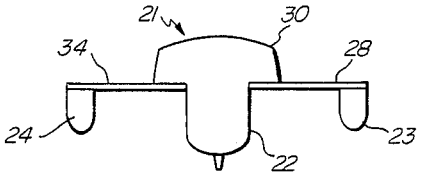
FIG. 12 is a schematic rear elevation view of the trimaran of FIG. 11 with its floats positioned as shown in FIG. 11.

FIGS. 11 and 12 illustrate the trimaran 21 with alternate starboard crossarms and port side crossarms removed in the manner described above. As shown in FIG. 12, first and third (odd) starboard crossarms 25 and 27 have been removed. Also, second and fourth (even) port side crossarms 33 and 35 have been removed.

Figure 13:
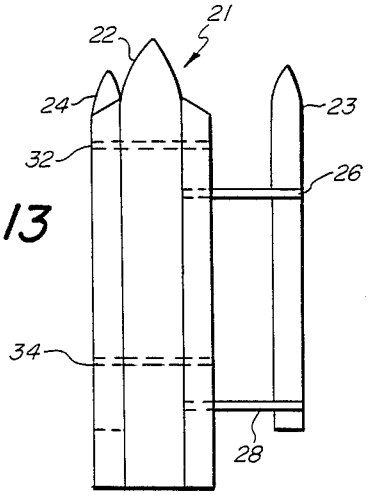
FIG. 13 is a schematic upper plan view of the trimaran of FIG. 1 with alternate starboard and port side float support crossarms removed, and with the port side float fully retracted.
Figure 14:
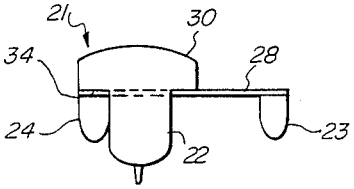
FIG. 14 is a schematic rear elevation view of the trimaran of FIG. 1 with its floats positioned as shown in FIG. 13.
Figure 6:
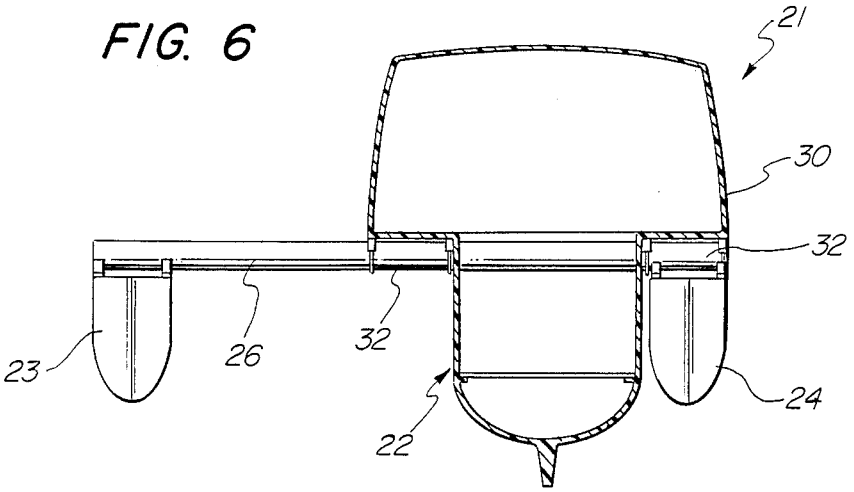
FIG. 6 is a sectional front elevation view of the trimaran of FIG. 1 with the first and third starboard float crossarms removed, the second and fourth port side crossarms removed, and the port side float in a fully retracted position.

With alternate odd numbered crossarms removed from the float on one side of the main hull 22 of trimaran 21, and alternate even number crossarms removed from the float on the opposite side of the main hull, clearance is provided which permits any crossarm to be slide inwards through a port hole 39 in one side of the main hull all the way across the width of the main hull, and out through the coaxial port hole in the opposite side of the hull. Thus, for example, the port side float 24 may be moved inwards until the inner lateral surface of the float contacts the port side 41 of main hull 22, by sliding the odd numbered port side crossarms through the port holes 42 in the port side of the main hull, and out through corresponding port holes in the starboard side 37 of main hull 22, clearance being provided outside the latter port holes by removal of odd numbered starboard crossarms. Thus, as illustrated in FIGS. 6, 13 and 14, the port side float 24 may be retracted fully until it abuts main hull 22, substantially reducing the beam of trimaran 21.

Figure 15:
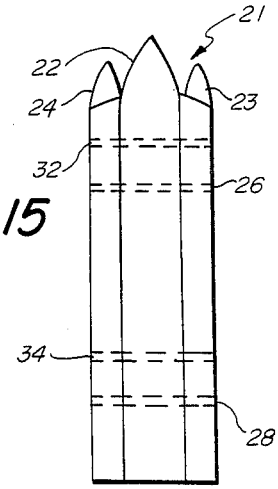
FIG. 15 is a schematic upper plan view of the trimaran of FIG. 1, with alternate crossarms removed and with both port side and starboard floats fully retracted to provide minimum beam to facilitate docking or trailering the trimarin.

When it is desired to reduce the beam of the trimaran 21 to a dimension even smaller than that achievable by fully retracting a single float, both floats may be fully retracted. Thus, as shown in FIGS. 15 and 16, the starboard float 23 may be fully retracted until it abuts the starboard side 38 of main hull 22, in a manner exactly as has been described above for fully retracting the port side float 24. Comparing FIGS. 15 and 5 with FIGS. 7 and 8, respectively, it may be seen that the novel trimaran construction according to the present invention affords a very efficient and advantageous mechanism for readily varying the beam of the vessel a substantial amount.

Figure 5:
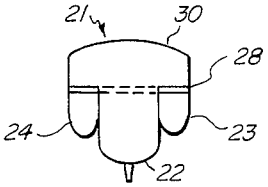
FIG. 5 is a schematic rear elevational view of the trimaran of FIG. 1 with its floats positioned as shown in FIG. 15.

With the beam of trimaran 21 reduced to a minimum value as shown in FIGS. 15 and 5, the vessel may be docked at locations which would have been difficult, if not impossible, for a full-width trimaran to dock at. The minimum width configuration of the trimaran 21 shown in FIGS. 15 and 5 also permits the trimaran to be transported more readily by a trailer or other means.

It is important to note that the variable beam capability afforded by the novel construction of the trimaran according to the present invention does not compromise strength and therefore the safety of the vessel. Thus the crossarms of the trimaran according to the present invention are not reduced in strength or rigidity by the incorporation of telescoping or pivoted joints. Moreover, the design and proof testing of the trimaran according to the present invention are such as to afford a thoroughly seaworthy craft even with every other crossarm on both floats entirely removed. Therefore, even with the vessel configured in preparation for reducing its beam prior to entering a port, it could withstand sudden, unexpected squalls, owing to the adequacy of strength and rigidity of the float support structure, even with half of the crossarms removed.

The trimaran construction according to the present invention has an additional novel and important feature which greatly enhances the versatility of the design, as will now be described.

Referring now to FIG. 4, the trimaran 21 according to the present invention is shown in a front sectional view. In FIG. 4, the waterline contacting trimaran 21 is approximately at the junction between starboard side 38 and port side 41 of the main hull 22 with curved bottom section 45 of the main hull. Thus, as shown in FIG. 4, trimaran 21 is sitting relatively low in the water. This large draft condition of trimaran 21 corresponds to a relatively large weight load of cargo and passengers, typical of a sailboat which is pleasure cruising.

As shown in FIG. 4, the curved bottom surface 46 and 47 of starboard float 23 and port side float 24, respectively, penetrate just below the surface A of the water. It has been founded that this minimum immersion depth of the floats of a trimaran provides optimum sailing performance.

When sailboats are used for racing, the weight load of cargo and persons is usually reduced substantially below that typical for cruising. Thus, the waterline is positioned substantially lower on the main hull than for the heavier loaded condition, lying below the junction of the straight side sections 38 and 41 with curved bottom section 45. With the trimaran 21 lightly loaded, and the floats 23 and 24 positioned vertically as shown in FIG. 4, the curved bottom surfaces 46 and 47 would be above the waterline, with the main hull level. This would cause the undesirable result of permitting the trimaran 21 to roll back and forth between positions in which a float cyclically contacted and penetrated the surface of the water, providing a bouyancy force limiting the roll angle.

The novel trimaran construction according to the present invention provides a convenient means of adjusting the penetration depth of its floats, thereby preventing the undesirable roll oscillations described above, and permitting optimization of the penetration depth of the floats. Thus, as shown in FIG. 4, and 4B, the novel structural features of trimaran 21 permitting easy fastening and unfastening of crossarms 25–28 and 32–35 to cabin superstructure 30 also permits shims to be positioned between the upper surface of the anchor blocks 31C and 31D and the lower surface of the cabin superstructure. Shims 48 which are uniform thickness blocks of material up to four inches thick, may be chosen to adjust the penetration depth of floats 23 and 24 to an optimum value for each loading condition of the main hull.

Figure 4A:
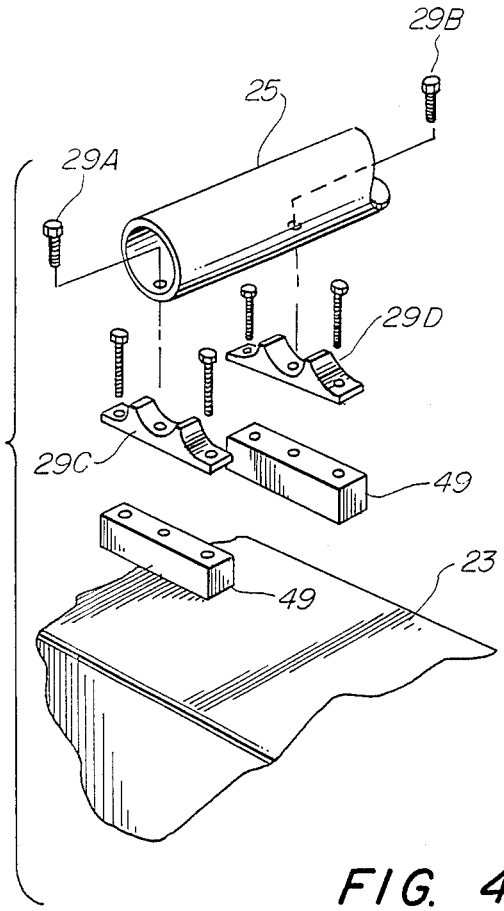
FIG. 4A is a fragmentary, exploded perspective view showing details of mounting a crossarm to a float.
Figure 4B:
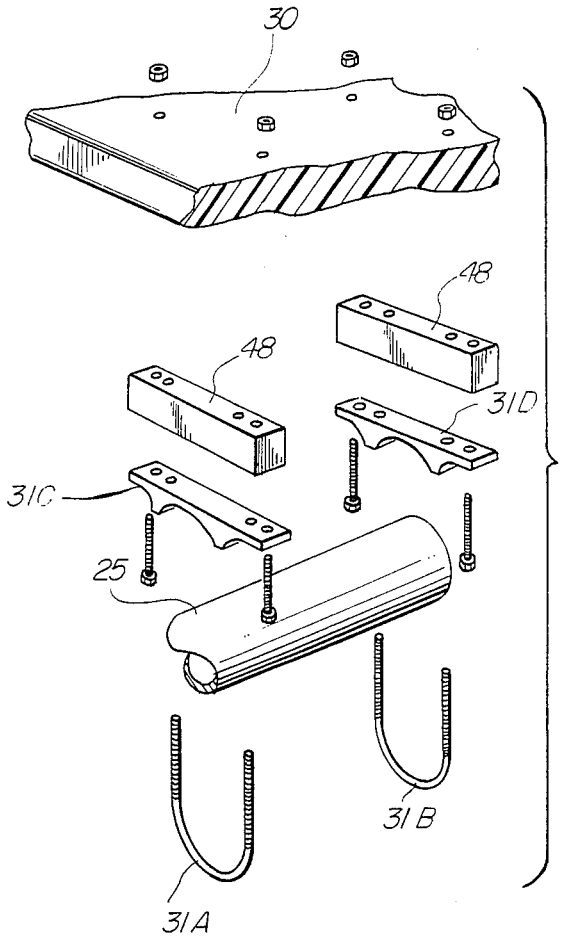
FIG. 4B is a fragmentary exploded perspective view of the trimaran of FIG. 1 showing details of mounting a crossarm to the main hull superstructure.

The lower surface of floats 23 and 24 can be made even lower relative to main hull 22 by placing shims 49 between the upper surface of the floats and the lower surface of anchor blocks 29C and 29D to which the outboard ends of the crossarms are bolted as shown in FIG. 4A.

What is claimed is:

1. A multi-hulled sailing vessel comprising:

a. an elongated main hull, said main hull including a superstructure having a floor extending laterally out from the sides of said main hull, above the water line, b. an elongated starboard hull, c. a pair of front starboard crossarms disposed transversely between a forward side section of said main hull and said starboard hull and a pair of rear starboard crossarms disposed transversely between an aft side section of said main hull and said starboard hull for securing said starboard hull to said main hull with the longitudinal axes of said main hull and said starboard hull in parallel alignment, d. A plurality of starboard apertures through the starboard side of said main hull, each of said starboard apertures adapted to slidably receive a separate one of said starboard crossarms, e. an elongated port-side hull secured to the port side of said main hull by means of port-side crossarms slidably fastened to said main hull, f. a plurality of port-side apertures through the port side of said main hull, each of said port-side apertures being adapted to slidably receive a separate one of said port-side crossarms, and each of said port-side apertures in coaxial alignment with a corresponding starboard aperture, g. tightenable means for slidably fastening the inner ends of said crossarms to said main hull, said tightenable means comprising a plurality of vertically disposed U-bolts cradling the perimetral surface of said crossarms, said U-bolts being secured to said floor of said supersturcture, h. removable means for securing the outer ends of said starboard crossarms to said starboard float and said port-side crossarms to said port-side float, and i. means for adjusting the height of the bottom surfaces of said starboard and portside hulls relative to the bottom surface of said main hull, said means comprising a shim of selected thickness adapted to receive the two straight shank portions of said U-bolt and adapted to fit between the upper surface of a crossarm and the lower surface of said superstructure floor.

2. The vessel of claim 1 further including additional means for adjusting the height of said bottom surfaces of said auxiliary hulls relative to the bottom surface of said main hull, said additional height adjusting means comprising a second selectable thickness shim insertable between the lower surface of the outer end of each of said crossarms and the upper surface of said float to which said crossarms are secured.

3. The vessel of claim 1 further comprising means for covering said apertures.

4. A variable beam trimaran comprising, a. an elongated main hull, b. an elongated starboard auxiliary hull secured in parallel alignment with said main hull by means of a front pair and a rear pair of elongated, transversely disposed starboard crossarms, said starboard crossarms being removably secured at their outer ends to said starboard auxiliary hull and said starboard crossarms being secured at their inner ends to said main hull by means permitting said crossarms to be slid laterally with respect to said main hull, parallel to the longitudinal axes of said crossarms, said means comprising U-bolts cradling said inner ends of said crossarms and loosenably fastened to said main hull, whereby tightening said U-bolts secures said auxiliary hull at a fixed lateral position relative to said main hull, and loosening said U-bolts permits sliding said crossarms and attached auxiliary hull laterally with respect to said main hull, c. a plurality of port holes through the starboard side of said main hull, each one of said port holes being in concentric alignment with the inner face of a separate one of said crossarms, the diameter of each said port hole being sufficiently large to slidably receive an adjacent one of said crossarms, d. an elongated port side auxiliary hull secured in parallel alignment with said main hull by means of a front pair and a rear pair of elongated, transversely disposed port-side crossarms, said port-side crossarms being removably secured at their outer ends to said port-side auxiliary hull and said port-side crossarms being secured to said main hull by means permitting said crossarms to be slid laterally with respect to said main hull, parallel to the longitudinal axes of said crossarms, said means comprising U-bolts cradling said inner ends of said crossarms and loosenably fastened to said main hull, whereby tightening said U-bolts secures said auxiliary hull at a fixed lateral position relative to said main hull, and loosening said U-bolts permits sliding said crossarms and attached auxiliary hull laterally with respect to said main hull, e. a plurality of port holes through the port side of said main hull, each one of said port holes being in concentric alignment with the inner face of a separate one of said crossarms, the diameter of each said port holes being sufficiently large to slidably receive an adjacent one of said crossarms, and f. means for adjusting the height of the bottom surfaces of said starboard auxiliary hull and said port-side auxiliay hull relative to the bottom surface of said main hull, said means comprising a selected thickness shim having holes adapted to receive the two straight shank portions of said U-bolt and adapted to fit between the upper surface of a crossarm and the lower surface of the structure of the main hull to which said straight shank portion of said U-bolt is fastened.

5. The trimaran of claim 4 further including additional means for adjusting the height of said bottom surfaces of said auxiliary hulls relative to said bottom surface of said main hull, said additional height adjusting means comprising a second selectable thickness shim insertible between the lower surface of the outer end of each of said crossarms and the upper surface of said float to which said crossarms are secured.

* * * * *